US007799101B2

(12) United States Patent
Dong et al.

(10) Patent No.: US 7,799,101 B2
(45) Date of Patent: Sep. 21, 2010

(54) STABILIZED LUBRICANT COMPOSITIONS

(75) Inventors: Jun Dong, Waterbury, CT (US); Cyril A. Migdal, Pleasant Valley, NY (US)

(73) Assignee: Chemtura Corporation, Middlebury, CT (US)

( * ) Notice: Subject to any disclaimer, the term of this patent is extended or adjusted under 35 U.S.C. 154(b) by 897 days.

(21) Appl. No.: 10/955,029

(22) Filed: Sep. 29, 2004

(65) Prior Publication Data

US 2006/0073992 A1 Apr. 6, 2006

(51) Int. Cl.
*C10L 1/18* (2006.01)
*C10L 1/22* (2006.01)

(52) U.S. Cl. ..... 44/421; 44/422; 44/423; 44/441; 44/442

(58) Field of Classification Search ..... 508/421, 508/422, 423, 441, 442
See application file for complete search history.

(56) References Cited

U.S. PATENT DOCUMENTS

| | | | | | |
|---|---|---|---|---|---|
| 2,612,488 | A | | 9/1952 | Nelson et al. | |
| 3,115,465 | A | * | 12/1963 | Orloff | 508/442 |
| 3,556,999 | A | | 1/1971 | Messina et al. | |
| 3,652,410 | A | * | 3/1972 | Hollinghurst et al. | 508/237 |
| 3,652,411 | A | | 3/1972 | Commichau | |
| 3,923,672 | A | | 12/1975 | Durr, Jr. et al. | |
| 4,652,385 | A | | 3/1987 | Cohen | |
| 5,108,634 | A | * | 4/1992 | Seiki | 508/584 |
| 5,124,057 | A | * | 6/1992 | Cohen | 508/257 |
| 5,232,614 | A | | 8/1993 | Colclough et al. | |
| 5,498,809 | A | | 3/1996 | Emert et al. | |
| 6,172,014 | B1 | | 1/2001 | Meyers | |
| 6,326,336 | B1 | | 12/2001 | Gatto et al. | |
| 2003/0171227 | A1 | | 9/2003 | Holt et al. | |

FOREIGN PATENT DOCUMENTS

| | | | |
|---|---|---|---|
| EP | 316610 | * | 5/1989 |
| GB | 923190 | | 4/1963 |
| JP | 02284994 | * | 11/1990 |

OTHER PUBLICATIONS

Reich, Autoxidation of Hydrocarbons and Polyolefins, Stevens Inst. Of Tech., 1969, pp. 246-249.
Muller, Plastics Additives Handbook, 4th Edition, 1993, pp. 104-128.

* cited by examiner

*Primary Examiner*—Cephia D Toomer
(74) *Attorney, Agent, or Firm*—Joseph Suhadolnik

(57) ABSTRACT

A stabilized lubricant composition is disclosed that comprises lubricating oil and a mixture of (a) at least one organophosphite compound and (b) at least one aromatic secondary amine or one substituted phenol or mixtures thereof. The compositions have been found to be highly resistant to oxidation under demanding service conditions.

6 Claims, No Drawings

STABILIZED LUBRICANT COMPOSITIONS

BACKGROUND OF THE INVENTION

1. Field of the Invention

This invention relates to stabilized lubricant compositions comprising lubricating oil and a class of synergistic mixtures of organophosphites and conventional antioxidants that impart excellent anti-oxidative stabilities and are particularly suitable for use in a high temperature iron-catalyzed environment.

2. Description of Related Art

Lubricating oils, when exposed to heat and oxygen (air), which are ubiquitously present during their manufacture, transportation, storage, or use, will oxidize to form undesirable oxidation by-products that contribute to an increase in total acidity, formation of gums, discoloration, polymerization, rancidity, and/or odor. As a consequence, loss of designated physical and tribological properties of the oils may occur. Conventional antioxidants, including aromatic secondary aminic antioxidants and phenolic antioxidants, are effective, at least to some extent, in controlling the oxidation of lubricating oils and are being widely used. The performances of the conventional antioxidants are generally satisfactory when the lubricants to be protected are used under relatively mild conditions without prolonged exposure to elevated temperatures and contaminants. In more extreme service environments, especially those contaminated with catalytic transition metals, such as iron, the decomposition rates of lubricants may increase so dramatically that even at higher concentrations, the conventional antioxidants do not retard oxidation effectively. This aspect is discussed in more detail by Miller, H., Plastics Additives Handbook, 4th Edition, Metal Deactivators, 1993, pages 106-128.

An effective method to address the aforementioned issue of iron-catalyzed oil oxidation is the use of metal deactivators that can counteract the catalytic effects from iron and other transition metals. However, as stated in the EP Publication No. 0 316 610 A1, the addition of metal deactivators to lubricants has given rise to a problem of decreasing the critical anti-seizure and antiwear properties of the antiwear/extreme pressure agents that are commonly used in lubricant formulations.

Lubricant compositions containing various aromatic secondary amines and substituted phenols are widely known in the art. The use of organophosphites as stabilizers for various lubricating substances is also known, although to a lesser extent.

U.S. Pat. No. 3,556,999 discloses hydraulic fluid compositions, particularly automatic transmission fluid compositions, containing a major amount of lubricating oil and a minor amount of each of (A) a phosphite or disubstituted phosphate, (B) a substituted phenol or an aromatic secondary amine and (C) an oil-soluble dispersant copolymer containing N-vinyl-2-pyrrolidone.

U.S. Pat. No. 3,652,411 discloses a polyglycol base lubricant containing, in minor proportion, as a stabilizer, a mixture comprising: a substituted amine, an aliphatically substituted phenol, and organic phosphate, a polyhydroxyquinone, a benzotriazole, an amine salt and a substituted organic phosphite.

U.S. Pat. No. 3,923,672 discloses a lubricating oil composition said to be particularly suitable for use in steam turbines or gas turbines. The turbine oil composition comprises a major amount of a mineral or synthetic hydrocarbon base oil and an effective amount of a combination of the following materials: triphenyl phosphite or a trialkyl-substituted phenyl phosphite; diphenylamine or alkylated diphenylamine; phenyl α-naphthylamine, phenyl β-naphthylamine, alkyl or alkaryl substituted phenyl α-naphthylamine, or alkyl or alkaryl substituted phenyl β-naphthylamine; benzotriazole or alkyl-substituted benzotriazole; partial ester of alkyl or alkenyl succinic anhydride. In a preferred aspect, the turbine oil composition contains additionally an effective amount of a copolymer of N-vinyl-2-pyrrolidone and an α-olefin.

U.S. Pat. No. 5,124,057 discloses lubricant compositions in which a synergistic combination of low-volatility tri-substituted phosphite and selected substituted isocyanurate phenolic stabilizers provide antioxidant qualities to lubricating oils selected from hydrotreated oils, poly-α-olefin oils, paraffinic white oils and mixtures thereof.

U.S. Pat. No. 5,232,614 discloses that substituted paraphenylene diamines have been found to be effective antioxidants capable of protecting crankcase lubricating oils from thickening and sludge formation after prolonged exposure to oxygen at elevated temperature.

U.S. Pat. No. 6,172,014 discloses an improved method of reducing compressor gas leakage by providing a compression cylinder with a lubricant comprising less than about 1% of a synergistic mixture of antioxidants.

U.S. Patent Publication No. 2003/0171227 discloses stabilising compositions for lubricant base stocks and lubricant formulations that are composed of a mixture of (a) at least one aromatic aminic amine antioxidant optionally blended with at least one hindered phenolic antioxidant and (b) at least one neutral organo phosphate or phosphite, optionally blended with at least one acid organo phosphate or phosphite. It is said that these stabilising composition mixtures are characterised by their stabilising capacity which is considerably higher than that of either the single antioxidants or the single phosphate or phosphite additives and can be used in all fields where the single components of the mixtures are generally used and where deterioration due to oxidation processes takes place.

The disclosures of the foregoing are incorporated herein by reference in their entirety.

SUMMARY OF THE INVENTION

It is an object of the present invention to provide an antioxidant that can either eliminate, or at least minimize the use of metal deactivators. In accordance therewith, it has been found that certain organophosphites with aromatic secondary aminic antioxidants and/or phenolic antioxidants possess unique anti-oxidation synergies and proper mixtures thereof are highly effective in stabilizing lubricating base stocks and lubricating oil formulations for use in environments where high temperatures and iron-catalyzed oxidative reactions can take place, e.g., lubricating oils for internal combustion engines and steam and gas turbines.

More particularly, the present invention relates to a stabilized lubricating oil composition for use in an environment where iron-catalyzed oxidation reactions can take place comprising:

(A) at least one lubricating base oil;

(B) at least one organophosphite compound selected from the group consisting of:

(i) di-substituted phosphites of the structure (I)

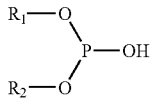

(ii) tri-substituted phosphites of the structure:

(II)

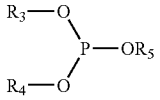

(iii) substituted diphosphites of the structure:

(III)

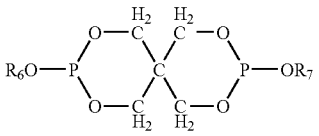

(iv) substituted diphosphites of the structure:

(IV)

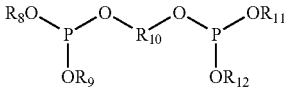

(v) substituted triphosphites of the structure:

(V)

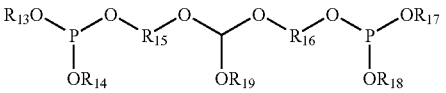

(vi) pentaerythritol tetraphosphites of the structure:

(VI)

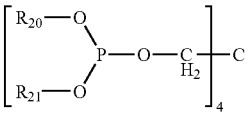

and (vii) trisubstitued thiophosphites of the structure:

(VII)

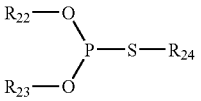

wherein $R_1$ through $R_5$, $R_{10}$, $R_{15}$, $R_{16}$, and $R_{22}$ through $R_{24}$ are independently selected from the group consisting of hydrocarbyl groups having 1 to 100 carbon atoms, and $R_6$ through $R_9$, $R_{11}$ through $R_{14}$, and $R_{17}$ through $R_{21}$ are independently selected from the group consisting of hydrogen and hydrocarbyl groups having 1 to 100 carbon atoms, or any of $R_1$ and $R_2$, $R_3$ and $R_4$, $R_8$ and $R_9$, $R_{11}$, and $R_{12}$, $R_{13}$ and $R_{14}$, $R_{17}$ and $R_{18}$, $R_{20}$ and $R_{21}$, $R_{22}$ and $R_{23}$ can be fused together to form a ring of 2-10, preferably 3-6, carbon atoms, which can be further substituted with alkyl, alkenyl, cycloalkyl, aryl, or alkoxy groups; and (C) at least one antioxidant selected from the group consisting of secondary aromatic amines, substituted phenols, and mixtures thereof, represented by the following formula (VIII)

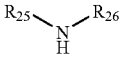

wherein $R_{25}$ and $R_{26}$ are independently substituted or unsubstituted aryl groups having from 6 to about 40 carbon atoms.

(IX)

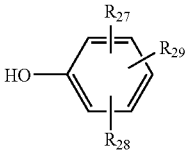

wherein $R_{27}$, $R_{28}$ and $R_{29}$ are independently hydrogen or hydrocarbyl groups having 1 to 100 carbon atoms, provided that at least one of the ortho position groups comprise alkyl, preferably with an iso- or tert.-structure.

As employed herein, the term "hydrocarbyl" includes hydrocarbon as well as substantially hydrocarbon groups. "Substantially hydrocarbon" describes groups that contain heteroatom substituents that do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic substituents, aromatic-, aliphatic-, and alicyclic-substituted aromatic substituents, and the like, as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups which, in the context of this invention, do not alter the predominantly hydrocarbon nature of the substituent; those skilled in the art will be aware of such groups (e.g., halo, hydroxy, mercapto, nitro, nitroso, sulfoxy, cyano, etc.);

(3) heteroatom substituents, i.e., substituents that will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen, and such substituents as, e.g., pyridyl, furyl, thienyl, imidazolyl, etc. Preferably, no more than about 2, more preferably no more than one, hetero substituent will be present for every ten carbon atoms in the hydrocarbyl group. Most preferably, there will be no such heteroatom substituents in the hydrocarbyl group, i.e., the hydrocarbyl group is purely hydrocarbon.

More particularly, the present invention is directed to a stabilized lubricant composition for use in an environment where iron-catalyzed oxidation reactions can take place comprising:

(A) at least one lubricating base oil;

(B) at least one organophosphite compound as described above; and (C) at least one antioxidant selected from the group consisting of secondary aromatic amines, substituted phenols, and mixtures thereof, as described above.

In another embodiment, the present invention is directed to a method for stabilizing lubricants against iron-catalyzed oxidation reactions comprising adding to the lubricant a stabilizing amount of a composition comprising:

(A) at least one lubricating base oil;

(B) at least one organophosphite compound as described above; and (C) at least one antioxidant selected from the group consisting of secondary aromatic amines, substituted phenols, and mixtures thereof, as described above.

DESCRIPTION OF THE PREFERRED EMBODIMENTS

The organophosphites represented by the general formulae (I) to (VII) have wide variation in the hydrocarbyl groups. The total number of carbon atoms in the hydrocarbyl groups must be sufficient to render the compound soluble in the base oil (A). In general, the total number of atoms in the hydrocarbyl groups is at least 8 and, practically, can be as many as about 100. Preferably, the hydrocarbyl groups have from 1 to about 100 carbon atoms, more preferably, from 1 to about 50 carbon atoms, and, most preferably, from 1 to about 30 carbon atoms, with the provision that the total number of carbon atoms is at least 8. Especially preferred examples of useful hydrocarbyls include, but are not limited to:

(A) straight chain or branched chain alkyl or alkenyl groups comprising from one to fifty carbon atoms, including, but not limited to, methyl, ethyl, propyl, butyl, pentyl, hexyl, heptyl, octyl, 2-ethyl hexyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, isomers of the foregoing, and the like;

(B) cyclic alkyl groups, including, but not limited to, cyclopentyl, cyclohexyl, cycloheptyl, cyclooctyl, cyclododecyl, and the like;

(C) unsubstituted phenyl;

(D) phenyl substituted with one or more alkyl groups, including, but not limited to, methyl, ethyl, propyl, butyl, pentyl, hexyl, heptyl, octyl, nonyl, decyl, isomers of the foregoing, and the like;

(E) phenyl substituted with one or more alkoxy groups, including, but not limited to, methoxy, ethoxy, propoxy, butoxy, pentoxy, hexoxy, heptoxy, octoxy, nonoxy, decoxy, isomers of the foregoing, and the like;

(F) phenyl substituted with one or more alkyl amino or aryl amino groups; and (G) naphthyl and alkyl substituted naphthyl.

Some of the organophosphite compounds useful in accordance with this invention are commercially available from Crompton Corporation (Middlebury, Conn.) and are the more preferred phosphites of choice for this invention.

Examples of the di-substituted phosphites represented by the general formula (I) include diphenyl phosphite under the trade designation Weston DPP and dilauryl phosphite under the trade designation Weston DLP.

Examples of the tri-substituted phosphites represented by the general formula (II) include triisooctyl phosphite under the trade designation Weston TIOP; triisodecyl phosphite under the trade designation Weston TDP; trilauryl phosphite under the trade designation Weston TLP; triphenyl phosphites under the trade names of Weston TPP and Weston EGTPP; phenyl diisodecyl phosphite under the trade designation Weston PDDP; diphenyl isodecyl phosphite under the trade designation Weston DPDP; tris(nonylphenyl) phosphites under the trade names of Weston TNPP and Weston 399; phenyl neopentylene glycol phosphite under the trade designation Weston PNPG; and tris(dipropyleneglycol) phosphite under the trade designation Weston 430.

Examples of the substituted diphosphites represented by the general formulae (III) and (IV) include diisodecyl pentaerythritol diphosphite under the trade designation Weston 600; distearyl pentaerythritol diphosphites under the trade names of Weston 618F and 619F; tetraphenyl dipropyleneglycol diphosphite under the trade designation Weston THOP; 4,4'-isopropylidenediphenol bisdecyl phosphite under the trade desgnation Weston 437, mixtures of isopropylidenediphenol bis-dodecyl phosphite and isopropylidenediphenol bis-pentadecyl phosphite under the trade designation Weston 439.

An example of the substituted triphosphites represented by the general formula (V) is heptakis dipropyleneglycol triphosphite under the trade designation Weston PTP.

An example of the pentaerythritol tetraphosphite represented by the general formula (VI) is tetraphenyltetratridecylpentaerythritol tetraphosphite and the like.

An example of the tri-substituted trithiophosphite represented by the general formula (VII) is trilauryl trithiophosphite under the trade designation Weston TLTTP and the like.

With regard to component (C), the aromatic secondary amines are well known antioxidants for lubricants, and there is no particular restriction on the types of the aromatic secondary amine that can be used as antioxidants in the practice of this invention. Preferably, the aromatic secondary aminic antioxidant is one with the representative formula (VIII) where $R_{25}$ and $R_{26}$ each independently represent a substituted or unsubstituted aryl group having from 6 to about 40 carbon atoms. Illustrative of substituents for the aryl moieties are aliphatic hydrocarbon groups, such as alkyl of 1 to 40 carbon atoms, hydroxyl, carboxyl, amino, N-alkylated amino, N-arylated amino, N'N-dialkylated amino, nitro, or cyano. The aryl moieties are preferably substituted or unsubstituted phenyl or naphthyl, particularly where one or both of the aryl moieties are substituted with alkyl, such as one having 4 to 24 carbon atoms. The alkyl substitutents, which can be of from 1 to 40 carbon atoms can have either a straight chain or a branched chain, which may be a fully saturated or a partially unsaturated hydrocarbon chain; for example, methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, tricosyl, tetracosyl, pentacosyl, triacontyl, pentatriacontyl, tetracontyl, and the like, and isomers and mixtures thereof.

Examples of some of the secondary diarylamines that are useful in the practice of the present invention include, but are not limited to, diphenylamine, monalkylated diphenylamine, dialkylated diphenylamine, trialkylated diphenylamine, or mixtures thereof, 3-hydroxydiphenylamine, 4-hydroxydiphenylamine, mono- and/or di-butyldiphenylamine, mono- and/or di-octyldiphenylamine, mono- and/or di-nonyldiphenylamine, phenyl-α-naphthylamine, phenyl-β-naphthylamine, diheptyldiphenylamine, mono- and/or di-(α-methylstyryl)diphenylamine, mono- and/or distyryidiphenylamine, 4-(p-toluenesulfonamido)diphenylamine, 4-isopropoxydiphenylamine, t-octylated N-phenyl-1-naphthylamine, mixtures of mono- and dialkylated t-butyl-t-octyldiphenylamines, N-phenyl-1,2-phenylenediamine, N-phenyl-1,4-phenylenediamine, N,N'-diphenyl-p-phenylenediamine, N,N'-di(naphthyl-2-)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, and N-cyclohexyl-N'-phenyl-p-phenylenediamine. The following are exemplary of the aromatic secondary aminic antioxidants just defined and are commercially available from Crompton Corporation: Naugalube® 438, Naugalube 438L, Naugalube 640, Naugalube 635, Naugalube 680, Naugalube AMS, Naugalube APAN, Naugard PANA, Naugalube 403, Naugalube 410, and Naugalube 420.

The substituted phenols represented by the formula (IX) are well known antioxidants for lubricants as well and there is no particular restriction on the types of the substituted phenols that can be used as antioxidants in the practice of this invention. With wide variation in the composition of the hydrocarbyl constituents, the phenolic antioxidants represented by formula (IX) useful in the practice of the invention may include alkylated mono-phenols; alkylated hydroquinones; hydroxylated thiodiphenyl ethers; alkylidenebisphenols; acylaminophenols; esters of (beta-) 3,5-di-tert-4-hydroxybenzene propionic acid with mono- or polyhydric alcohols; esters of (beta-)5-tert-butyl-4-hydroxy-3-methylbenzene propionic acid with mono- or polyhydric alcohols; amides of beta (3,5 di-tert-butyl-4-hydroxyphenyl)propionic acid. Examples of some of the phenolic antioxidants that are useful for the practice of this invention are 2,6-di-tert-butyl-4-methylphenol, 2,6-di-tert-butylphenol, 2-tert-butyl-4,6-dimethylphenol, 2,6-di-tertbutyl-4-ethylphenol, 2,6-di-tert-butyl-4-isobutylphenol, 2,6-bis(alpha-methylbenzyl)-4-methylphenol and 2-alpha-methylbenzyl-4-methylphenol, and the like; 2,6-di-tert-butyl-4-methoxyphenol, 2,5-di-tert-butyl-hydroquinone and the like; 3,5-di-tert-butyl-4-hydroxybenzene-3-propionic acid esterified with methanol, octanol, octadecanol, 1,6-hyxanediol, neopentyl glycol, thiodiethylene glycol, diethylene glycol, triethylene glycol, pentaerythritol, and the like. The following are exemplary of more preferred phenolic antioxidants that are commercially available from Crompton Corporation: Naugard® BHT, Antioxidant 431, and Naugalube 531.

In the practice of this invention, the component (B) comprising at least one organophosphite compound selected from the group with the above general formulae (I)-(VII) can be blended in the lubricating oil compositions of the present invention in a range of from about 0.01 to about 10 weight percent, and preferably from about 0.1 to about 5 weight percent. The component (C) comprising at least one aromatic secondary aminic antioxidant with the above general formula (VIII) or phenolic antioxidant with the above general formula (IX) or mixtures thereof can be blended in the lubricating oil compositions of the present invention in a range of from about 0.01 to about 10 total weight percent, and preferably from about 0.1 to about 5 weight percent.

The content ratio of the two antioxidants in the event of mixture is not critical, but it is preferably from about 80:20 to about 20:80 parts by weight. The content ratio of the organophosphite to the antioxidant or antioxidant mixture employed in the lubricating oil compositions of the present invention can be in practically all proportions. But preferably, the ratio will be in the range of 1:99 to 99:1 parts by weight, and more preferably, from about 80:20 to about 20:80 parts by weight.

The components (B) and (C) can be pre-mixed then added to, or component (B) and component (C) can be separately added to, the lubricating oil compositions of the present invention with the aids of mild heating (50° C.) and mechanical agitation as needed.

The combination of organophosphite and antioxidant(s) of the present invention can be used in conjunction with other additives typically found in lubricating oils, as well as other antioxidants. The additives typically found in lubricating oils are, for example, dispersants, detergents, antiwear agents, antioxidants, friction modifiers, seal swell agents, demulsifiers, VI (viscosity index) improvers, pour point depressants, and the like. Such additives are well known to those skilled in the art and there is no particular restriction on the type of these additives for this invention. U.S. Pat. No. 5,498,809 discloses useful lubricating oil composition additives, the disclosure of which is incorporated herein by reference in its entirety.

Examples of dispersants include polyisobutylene succinimides, polyisobutylene succinate esters, Mannich Base ashless dispersants, and the like.

Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants include alkylated diphenylamines, N-alkylated phenylenediamines, phenyl-α-naphthylamine, alkylated phenyl-α-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like. The following are exemplary of such additives and are commercially available from Crompton Corporation: Naugalube 438, Naugalube 438L, Naugalube 640, Naugalube 635, Naugalube 680, Naugalube AMS, Naugalube APAN, Naugard PANA, Naugalube TMQ, Naugalube 531, Antioxidant 431, Naugard BHT, Naugalube 403, and Naugalube 420, among others.

Examples of anti-wear additives that can be used in combination with the additives of the present invention include organoborates, organophosphites, organophosphates, organic sulfur-containing compounds, sulfurized olefins, sulfurized fatty acid derivatives (esters), chlorinated paraffins, zinc dialkyldithiophosphates, zinc diaryldithiophosphates, dialkyldithiophosphate esters, diaryl dithiophosphate esters, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; and from Ciba Corporation: Irgalube 353.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. The following are exemplary of molybdenum additives and are commercially available from R. T. Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K.K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others. Naugalube MolyFM is also exemplary of such additives and is commercially available from Crompton Corporation.

An example of an anti-foamant is polysiloxane, and the like. Examples of rust inhibitors are polyoxyalkylene polyol, benzotriazole derivatives, and the like. Examples of V.I. improvers include olefin copolymers and dispersant olefin copolymers, and the like. An example of a pour point depressant is polymethacrylate, and the like.

Lubricant Compositions

Compositions, when they contain these additives, are typically blended into the base oil in amounts such that the additives therein are effective to provide their normal attendant functions. Representative effective amounts of such additives are illustrated in Table 1.

TABLE 1

| Additives | Preferred Weight % | More Preferred Weight |
|---|---|---|
| V.I. Improver | 1-12 | 1-4 |
| Corrosion Inhibitor | 0.01-3 | 0.01-1.5 |
| Antioxidant | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention, together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, tallow oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{18}$ monocarboxylic acids and polyols and polyol ethers. Other esters useful as synthetic oils include those made from copolymers of α-olefins and dicarboxylic acids which are esterified with short or medium chain length alcohols.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a V.I. of at least 130, preferably at least 135 or higher and, following dewaxing, a pour point of about −20° C. or lower.

The lubricating oil used in the practice of the present invention can be selected from any of the base oils in Groups I-V as broadly specified in the American Petroleum Institute (API) Base Oil Interchangeability Guidelines. The five base oil groups are described in Table 2.

TABLE 2

| API Base Oil Category | Sulfur (%) | | Saturates (%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, steam and gas turbine lubricants, automatic transmission fluids, gear lubricants, compressor lubricants, metal-working lubricants, hydraulic fluids, and other lubricating oil and grease compositions.

The additives can also be used to stabilize motor fuel compositions.

The advantages and the important features of the present invention will be demonstrated in the following examples.

EXAMPLES

Pressurized Differential Scanning Calorimetry Results

The Pressurized Differential Scanning Calorimetry (PDSC) data in Table 4 are a measure of the oxidation induction time (OIT) of each blend. The PDSC instrument used is a Mettler DSC27HP manufactured by Mettler-Toledo, Inc. The PDSC method employs a steel cell under constant oxygen pressure throughout each run. The instrument has a typical repeatability of ±5.0 minutes with 95 percent confidence for an OIT of 200 minutes. The PDSC test conditions are given in Table 3. All test formulations were blended for 15 minutes under a nitrogen atmosphere. For every 50 grams of test blend prepared, 40 μL of oil soluble ferric naphthenate (6 weight percent in mineral oil) was added, prior to PDSC testing, to facilitate 50 ppm of iron in oil. At the beginning of a PDSC run, the PDSC steel cell is pressurized with oxygen and heated at a rate of 40° C. per minute to the isothermal temperature listed in the results table. The induction time is measured from the time the sample reaches its isothermal temperature until the enthalpy change is observed. The longer the oxidation induction time, the better the oxidation stability of the oil. Each data point is the average of two runs on a single test blend.

TABLE 3

| Test Parameters | PDSC Test Conditions |
|---|---|
| Temperature | Variable (see data Tables) |
| $O_2$ Gas Pressure | 500 psi |
| $O_2$ Gas Flow Rate Through Cell | 100 ml/min. |
| Catalyst | 50 ppm of Iron |
| Sample Holder | Open Aluminum Pan |
| Sample size | 1.0-2.0 mg |
| Induction Time | Enthalpy Change |

The listed data in Table 4 were generated in a Group I base oil (Exxon 100 LP, ExxonMobil Corporation). The total amount of added additives including organophosphite, aromatic secondary amine, and/or substituted phenol according to the present invention was 1.0 weight percent in each blend. The aromatic secondary amine used in the test was a complex mixture of mono-, di- and tri-nonyl diphenyl amines currently sold under the trade designation Naugalube 438L; the substituted phenol used was octyl 3-[3,5-di(tert-butyl)-4-hydroxyphenyl]propanoate currently sold under the trade designation Naugalube 531. The phosphites employed included a triphenyl phosphite currently sold under the trade designation Weston TPP; a triisodecyl phosphite under the trade designation Weston TDP, a diisodecyl pentaerythritol diphosphite under the trade designation Weston 600, and a dilauryl phosphite. All components are commercially available from Crompton Corporation. Each blend was tested under the PDSC conditions described in Table 3 either at 165° C. or at 185° C. as specified in the data table.

The OIT results in the data table demonstrate that the lubricating oil compositions containing appropriate mixtures of organophosphites and antioxidants according to the present invention have superior oxidative stabilities against high temperature and iron-catalyzed oxidation reactions. The synergistic effects are particularly strong with blends 16 and 20, which respectively contained mixtures of diisodecyl pentaerythitol diphosphite (Weston 600), dilauryl phosphite with the alkylated diphenyl amine-based Naugalube 438L.

TABLE 4

PDSC Results in Group I Base Oil Formulation

| Blend | Antioxidant (wt %) | Phosphite (wt %) | PDSC Temp. ° C. | PDSC OIT, min. |
|---|---|---|---|---|
| 1 | Naugalube 438L (1.0) | — | 165 | 30.6 |
| 2 | Naugalube 531 (1.0) | — | 165 | 8.0 |
| 3 | Naugalube 438L (0.5)<br>Naugalube 531 (0.5) | | 165 | 21.5 |
| 4 | — | Weston TPP (1.0) | 165 | 9.3 |

TABLE 4-continued

PDSC Results in Group I Base Oil Formulation

| Blend | Antioxidant (wt %) | Phosphite (wt %) | PDSC Temp. ° C. | PDSC OIT, min. |
|---|---|---|---|---|
| 5 | Naugalube 438L (0.5) | Weston TPP (0.5) | 165 | 56.1 |
| 6 | Naugalube 531 (0.5) | Weston TPP (0.5) | 165 | 19.1 |
| 7 | Naugalube 438L (0.333) Naugalube 531 (0.333) | Weston TPP (0.333) | 165 | 66.4 |
| 8 | — | Weston TDP (1.0) | 165 | 13.3 |
| 9 | Naugalube 438L (0.5) | Weston TDP (0.5) | 165 | 65.7 |
| 10 | Naugalube 531 (0.5) | Weston TDP (0.5) | 165 | 16.4 |
| 11 | Naugalube 438L (0.333) Naugalube 531 (0.333) | Weston TDP (0.333) | 165 | 41.1 |
| 12 | Naugalube 438L (1.0) | — | 185 | 8.5 |
| 13 | Naugalube 531 (1.0) | — | 185 | 2.8 |
| 14 | Naugalube 438L (0.5) Naugalube 531 (0.5) | — | 185 | 5.9 |
| 15 | — | Weston 600 (1.0) | 185 | 4.1 |
| 16 | Naugalube 438L (0.5) | Weston 600 (0.5) | 185 | 223.1 |
| 17 | Naugalube 531 (0.5) | Weston 600 (0.5) | 185 | 42.4 |
| 18 | Naugalube 438L (0.333) Naugalube 531 (0.333) | Weston 600 (0.333) | 185 | 85.0 |
| 19 | — | Dilauryl phosphite (1.0) | 185 | <1.0 |
| 20 | Naugalube 438L (0.5) | Dilauryl phosphite (0.5) | 185 | 238.0 |
| 21 | Naugalube 531 (0.5) | Dilauryl phosphite (0.5) | 185 | 42.0 |
| 22 | Naugalube 438L (0.333) Naugalube 531 (0.333) | Dilauryl phosphite (0.333) | 185 | 118.6 |

In view of the many changes and modifications that can be made without departing from principles underlying the present invention, reference should be made to the appended claims for an understanding of the scope of the protection to be afforded the invention.

What is claimed is:

1. A stabilized lubricant composition for use in an environment where iron-catalyzed oxidation reactions can take place comprising:

(A) at least one lubricating base oil;

(B) from about 0.333 weight percent to about 0.5 weight percent of a diisodecyl pentaerythritol diphosphite; and (C) from about 0.333 weight percent to about 0.5 weight percent of a mixture of mono-, di-, and tri-nonylated diphenyl amines.

2. The composition of claim 1 further comprising at least one additional additive selected from the group consisting of dispersants, detergents, rust inhibitors, metal deactivators, antiwear agents, antifoamants, friction modifiers, seal swell agents, demulsifiers, viscosity index improvers, and pour point depressants.

3. A method for stabilizing lubricants against iron-catalyzed oxidation reactions in a lubricant comprising adding to the lubricant a stabilizing amount of a composition comprising:

(A) from about 0.333 weight percent to about 0.5 weight percent of diisodecyl pentaerythritol diphosphite; and (B) from about 0.333 weight percent to about 0.5 weight percent of a mixture of mono-, di-, and tri-nonylated diphenyl amines.

4. The composition of claim 3 further comprising at least one additional additive selected from the group consisting of dispersants, detergents, rust inhibitors, metal deactivators, antiwear agents, antifoamants, friction modifiers, seal swell agents, demulsifiers, viscosity index improvers, and pour point depressants.

5. A stabilized lubricant composition for use in an environment where iron-catalyzed oxidation reactions can take place consisting of:

(A) at least one lubricating base oil;

(B) from about 0.333 weight percent to about 0.5 weight percent of at least one organophosphite compound selected from the group consisting of:

a diisodecyl pentaerythritol diphosphite; and (C) from about 0.333 weight percent to about 0.5 weight percent of a mixture of mono-, di-, and tri-nonylated diphenyl amines.

6. A method for stabilizing lubricants against iron-catalyzed oxidation reactions in a lubricant comprising adding to the lubricant a stabilizing amount of a composition comprising:

(A) from about 0.333 weight percent to about 0.5 weight percent of at least one organophosphite compound selected from the group consisting of:

a diisodecyl pentaerythritol diphosphite; and (B) from about 0.333 weight percent to about 0.5 weight percent of a mixture of mono-, di-, and tri-nonylated diphenyl amines.

* * * * *